US005245881A

United States Patent [19]

Rometsch

[11] Patent Number: 5,245,881

[45] Date of Patent: Sep. 21, 1993

[54] STARTING DEVICE WITH DRIVE SHAFT LOCK

[75] Inventor: Werner Rometsch, Gerlingen, Fed. Rep. of Germany

[73] Assignee: Robert Bosch GmbH, Stuttgart, Fed. Rep. of Germany

[21] Appl. No.: 916,821

[22] PCT Filed: Feb. 22, 1991

[86] PCT No.: PCT/DE91/00142

§ 371 Date: Jul. 30, 1992

§ 102(e) Date: Jul. 30, 1992

[87] PCT Pub. No.: WO91/14096

PCT Pub. Date: Sep. 19, 1991

[30] Foreign Application Priority Data

Mar. 3, 1990 [DE] Fed. Rep. of Germany ..... 4006796

[51] Int. Cl.[5] ..... F02N 15/10; H01H 67/02

[52] U.S. Cl. ..... 74/7 A; 335/131

[58] Field of Search ..... 74/7 R, 7 A; 335/131

[56] References Cited

U.S. PATENT DOCUMENTS 3,356,735 11/1982 Bögner et al. ..... 74/7 A 4,637,267 1/1987 Mazzorana ..... 74/7 A 4,929,857 5/1990 Isozumi ..... 74/7 A X

FOREIGN PATENT DOCUMENTS 1512520 2/1968 France .

1527196 5/1968 France .

*Primary Examiner*—Allan D. Herrmann

*Assistant Examiner*—David W. Laub

*Attorney, Agent, or Firm*—Michael J. Striker

[57] ABSTRACT

A starting device has a pinion for a drive of a toothed rim of an internal combustion engine, an engaging relay having an armature which axially displaces the pinion, a free wheel device and a stator rotor in which the pinion cooperates, a locking device which prevents a pre-engagement of the pinion in an unexcited state of the engaging relay. The locking device has a stationary locking element which engages behind a part actuated by the armature for securing a rest position of the pinion. The armature has a tappet on which a control sleeve is arranged. The locking element is formed as a first spring provided with at least one undercut step and deflectable in a release position by the control sleeve arranged on the tappet of the armature.

10 Claims, 3 Drawing Sheets

STARTING DEVICE WITH DRIVE SHAFT LOCK

BACKGROUND OF THE INVENTION

The invention is directed to a starting device having an engaging relay whose armature axially displaces a pinion for the drive of a toothed rim of an internal combustion engine via an engaging lever, which pinion cooperates with a freewheel device and a starting motor, and having a locking apparatus which prevents the pre-engagement of the pinion when the engaging relay is not excited.

In automotive technology, such starting devices are used for starting the internal combustion engines of vehicles. In meshing systems provided with engaging relays, a pre-engagement drive is provided which engages a pinion of the starting device in a toothed rim of the internal combustion engine. When initiating the starting process, the engaging relay attracts and moves the pinion in the axial direction via an engaging lever in such a way that it can engage with the toothed rim of the internal combustion engine. A starter motor begins to rotate simultaneously. As soon as the pinion meshes in the toothed rim as a result of the thrust movement, it is securely held by it and moves further in the axial direction up to a stop as a result of the rotation of the starter motor with the aid of a steep thread associated with the output drive shaft. At the conclusion of the starting process, a return spring presses the armature of the engaging relay back and accordingly—via the engaging lever—presses the pinion back into its rest position. This disengagement is reinforced by the steep thread in the overrunning effected by the starting of the internal combustion engine. The freewheel device protects the starter rotor from excessive rates of rotation during the overrunning by the internal combustion engine. When the starter slows down due to braking moments, e.g. caused by a shaft sealing ring and/or the existing bearings, the output drive shaft which carries the pinion and is provided with the steep thread tends to move in the direction of the toothed rim of the internal combustion engine when the forces of the return spring acting against this movement are greater than the axial force component at the steep thread, particularly in free-thrusting starting devices. The pinion can accordingly run against the running toothed rim of the internal combustion engine and be damaged. To prevent this, known starting devices are provided with a ball lock for example. In the rest position, a spring-loaded slide secures the axial position of the output drive shaft carrying the pinion. In the unlocking process the aforementioned slide is displaced so that the ball can be displaced radially outward. This releases the output drive shaft for an axial movement. This ball lock requires high-precision structural component parts which are expensive to build, resulting in a complicated and expensive type of construction.

SUMMARY OF THE INVENTION

Accordingly, it is an object of the present invention to provide a starting device, particularly a free-thrusting starting device of the above mentioned type, which avoids the disadvantages of the prior art.

In keeping with these objects and with others which will become apparent hereinafter, one feature of the present invention resides, briefly stated, in a starting device in which the locking element is formed as a first spring provided with at least one undercut step and deflectable in a release position by a control sleeve arranged on a tappet of the armature engaging relay.

When the starting device s designated in accordance with the present invention, it has the advantage that it reliably prevents the pre-engagement of the output drive shaft carrying the pinion in the unexcited state of the engaging relay in a simple construction. Since the locking device acts at the armature of the engaging relay according to the invention to secure the rest position of the pinion, no complicated ball lock is required; instead, simple constructions can be resorted to since there is sufficient space for such constructions in the region of the engaging relay. Therefore, in contrast to the prior art, one is not limited to constructions which must be accommodated in the region of the output drive shaft. Moreover, the locking device according to the invention which acts on the armature of the engaging relay and accordingly on the engaging lever can be assembled in a simple manner since no special assembly positions are required for accommodating the balls as is the case in the known ball lock.

According to a further development of the invention it is provided that the locking device has a locking element engaging behind a stop of the armature in the drop-out position of the engaging relay. This locking element can be displaced into the release position by a positive guidance due to the attracting movement of the armature. Thus, as long as the armature of the engaging relay is located in the drop-out position, the armature and accordingly the engaging lever and the output drive shaft provided with the pinion are locked in a position in which the pinion cannot run against the toothed rim of the internal combustion engine. The attracting movement of the armature takes place as a result of the excitation of the engaging relay brought about by the initiation of the starting process of the internal combustion engine. This attracting movement cancels the locking by means of a positive guidance, i.e. it displaces the locking element into the release position. The engaging lever is accordingly released and can be swiveled by the armature so that the pinion arranged on the output drive shaft is axially displaced and meshes in the toothed rim of the internal combustion engine. At the conclusion of the starting process, a de-excitation of the engaging relay is effected so that the return spring moves the armature back into the rest position (drop-out position) and the output drive shaft is carried along via the engaging lever. When the drop-out end position is reached the locking element secures the armature position so as to prevent another impermissible pre-engagement.

In particular, it is provided that the armature traverses an idling path to bring about the release position before the engaging lever is carried along. Due to this idling path it is possible that the locking element can first be shifted into its release position, i.e. an unlocking position is brought about by the movement of the armature so as to enable the engaging lever to be carried along for the meshing of the pinion subsequently in the course of the continued movement of the armature.

The locking element is preferably a first spring which is provided with at least one undercut step and can be deflected into the release position by means of a control sleeve arranged on a tappet of the armature. The control sleeve moving with the armature accordingly displaces the locking element into the release position. On the other hand, the control sleeve releases the locking element constructed as a spring in the drop-out position of the engaging relay so that the undercut step secures the armature position of the engaging relay.

The stop is preferably formed by a ring which is supported on the control sleeve. The axial position of the ring can be fixed or released by the locking element. A swiveling movement of the engaging lever is prevented by the fixed position of the ring so that the output drive shaft can not achieve its pre-engaging position.

According to a preferred embodiment form, the control sleeve contacts an armature stop as a result of the force of a second spring. This position of the control sleeve is then only relinquished by an increased tensioning of the second spring when an engagement of the pinion in the toothed rim of the internal combustion engine is at first prevented because of a tooth-on-tooth position. The second spring nevertheless enables the attraction of the engaging relay so that contacts of the engaging relay are closed for starting the rotating movement of the starting device. This causes a relative movement between the pinion and toothed rim so that a corresponding pinion tooth can enter into a tooth gap at the toothed rim. Moreover, in the aforementioned tooth-on-tooth position, a pressure spring associated with the pinion can also be tensioned, enabling a relative movement between the pinion and the output drive shaft.

It is clear from the preceding that the control sleeve is arranged so as to be axially displaceable against the force of the second spring relative to the armature in its drop-out direction.

As already mentioned, one side of the ring cooperates with the engaging lever—taking into account the idling path. The other side of the ring is acted upon by a third spring. The ring accordingly occupies a securing position for the engaging lever in the unexcited state of the engaging relay. In particular, one end of the third spring is supported at the housing of the starting device and the other end is supported at the ring.

According to a preferred embodiment example, a control sleeve stop is provided which defines a displacement path of the ring in the drop-out direction which is made possible by the force of the third spring. The control sleeve stop accordingly permits a displacement of the ring by the force of the third spring only until a determined position.

In particular, the first spring is constructed as a stirrup spring having an undercut step at each leg. The stirrup spring can spread apart for occupying the release position as a result of the displacement of the control sleeve.

The second spring is preferably a helical pressure spring which spirals around the tappet and is supported at a tappet stop by one end and abuts against a control sleeve step with its other end. The control sleeve is accordingly pretensioned in the direction of the armature so that it contacts the armature stop.

The third spring can be constructed as a spiral pressure spring surrounding the control sleeve. Accordingly a construction is achieved which is simpler and takes up less space.

The control sleeve has a control collar for the spreading of the stirrup spring.

The stirrup spring is fastened at the housing of the starting device so as to be adjustable in the direction of the longitudinal extension of the tappet for adjusting the device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
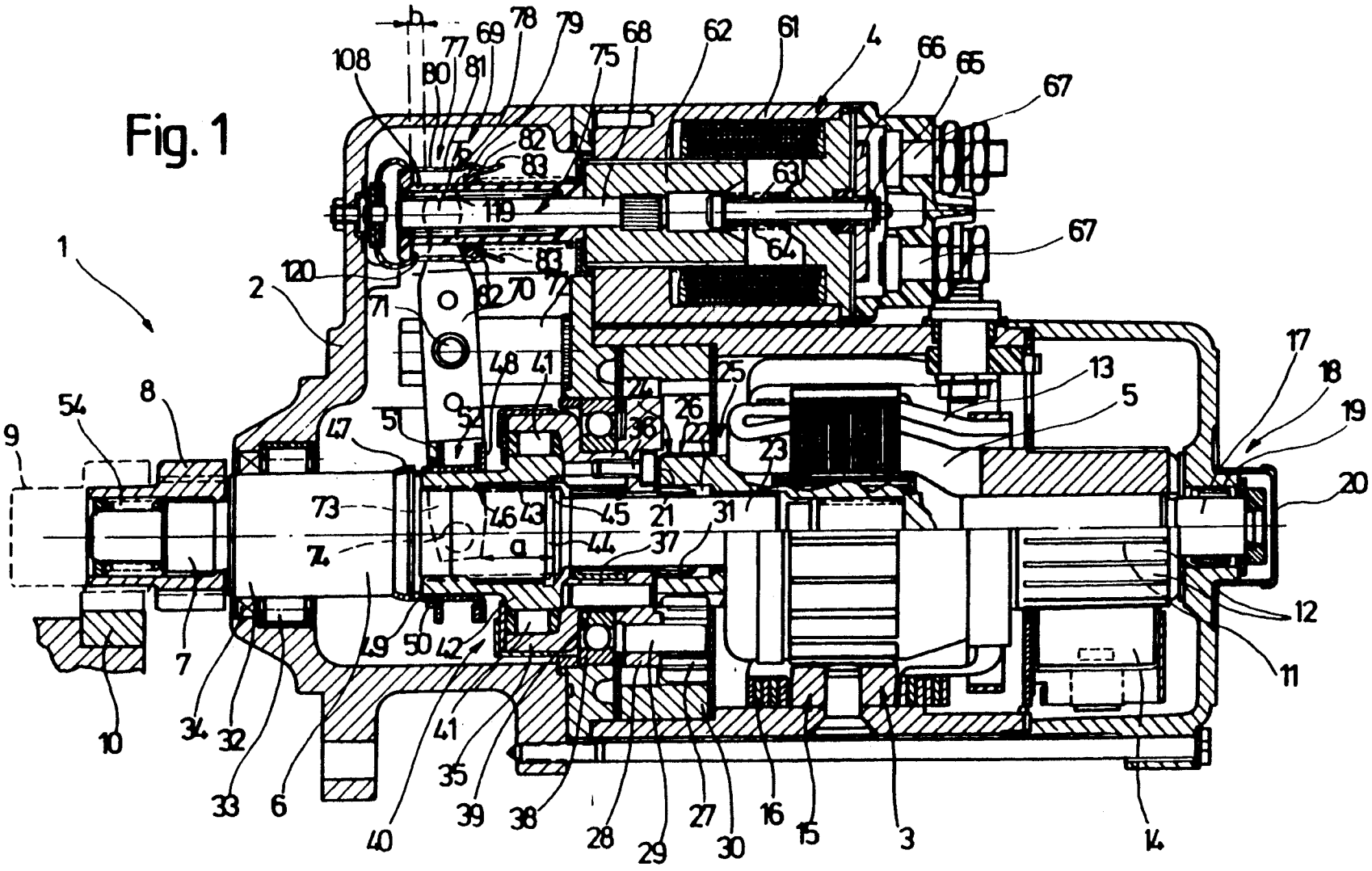
FIG. 1 shows a longitudinal section through a starting device.

FIG. 1 shows a longitudinal section through a starting device 1. The latter has a housing 2 in which a D.C. motor 3 and an engaging relay 4 are accommodated. The D.C. motor 3 has a starter rotor 5 which acts on an output drive shaft 6, a pinion 8 being rotatably arranged on the end 7 of the latter. The pinion 8 moves forward into the position 9 shown in dashed lines in FIG. 1 for the starting operation of an internal combustion engine, not shown, and in so doing meshes in a toothed rim 10 of the internal combustion engine. The axial displacement of the pinion into position 9 is caused by the engaging relay 4. This will be explained in more detail in the following.

The starter rotor 5 is provided with a commutator 11, a rotor winding 13 adjoining the segments 12 of the latter. The commutator 11 cooperates with a carbon brush arrangement 14. Further, a stator 15 is provided with a stator winding 16 which is located opposite the starter rotor 5 across a slight air gap.

The starter rotor 5 has a rotor shaft 17 which is supported at one of its ends 18 in a needle bearing 19 and is covered by a housing cap 20. The other end of the rotor shaft 17 has a central receiving bore hole 22 proceeding from its front side 21 in which one end 23 of the output drive shaft 6 engages. The other end of the rotor shaft 17 is supported on the end 23 of the output drive shaft 6 via a needle bearing 31 arranged in the receiving bore hole 22. The outer surface area 24 of the end 25 of the rotor shaft 17 provided with the receiving bore hole 22 is constructed as a sun wheel 26 which meshes with planet gears 27 arranged on a planet carrier 28 (only one of which planet gears 27 is shown in FIG. 1). The planet gears 27 are arranged on bearing pins 29 with the intermediary of needle bearings.

Further, the planet gears 27 mesh with an internal geared wheel 30 which is provided with inner teeth and arranged so as to be stationary in the housing 2.

The end 23 of the output drive shaft 6 is supported in the receiving bore hole of the axial crosspiece 39 via a needle bearing 37. The freewheel outer ring 35 is held by a grooved ball bearing 38 which is arranged on the axial crosspiece 39 and is supported in the housing 2 on the other side (fixed bearing). A cylindrical roller bearing 33 held by the housing 2 is provided in the opposite end region 32 of the output drive shaft 6, a shaft seal 34 being arranged in front of the cylindrical roller bearing 33 at the outside. The cylindrical roller bearing 33 guides the output drive shaft 6 in both the axial and radial directions.

The planet carrier 28 is axially connected with a freewheel outer ring 35 by screws 36.

The freewheel outer ring 35 belongs to a freewheel device 40 which is constructed as a roller-type freewheel. It has rollers 41 which are acted upon by springs and cooperate with an inner ring 42 of the freewheel device 40. The inner ring 42 communicates with the output drive shaft 6 via a steep thread 43. Further, the output drive shaft 6 has a groove 44 in which a retaining ring 45 is arranged. The retaining ring 45 forms a stop which cooperates with a step 46 of the inner ring 42 in an axial displacement of the output drive shaft 6 which will be described in more detail in the following.

A holding ring 47 which has a radial collar 48 is fastened on the output drive shaft 6. Further, a retainer ring 50 which supports a disk 51 lies in a groove 49 of the holding ring 47. An annular duct 52 is accordingly formed between the disk 51 and the radial collar 48.

The pinion 8 is supported at the end 7 of the output drive shaft 6 so as to be fixed with respect to rotation but axially displaceable relative to it. It is acted upon by a helical pressure spring 54. The latter is pretensioned when a tooth-on-tooth position results in the meshing of the pinion 8 in the toothed rim 10.

The engaging relay 4 has a stationary relay winding 61 which cooperates with an armature 62. The armature 62 is supported so as to be axially displaceable and is displaced into the position shown in FIG. 1 by a return spring 113 constructed as a helical pressure spring in the unexcited state of the engaging relay 4. The axle 63 has a contact element 66 in one end region 65 which can cooperate with electrical connections 67.

The armature 62 is connected with a tappet 68 which projects into a housing space 69 of the housing 2. The tappet 68 cooperates with an engaging lever 70 which is formed as a double lever and supported so as to be swivelably movable approximately in its center region by means of a cross-pin 71. The cross-pin 71 is held at a post 72 on the housing side. The lower end 73 of the engaging lever 70 is provided with a projection 74 which engages in the annular duct 52. A driving head 76 is formed at the other end 75 of the engaging lever 70. The engaging lever 70 is carried along by the displacement of the tappet 68 so that an axial displacement of the output drive shaft 6 is effected. In the unexcited state of the engaging relay 4 care must be taken that the pinion 8 does not leave the position shown in FIG. 1 in solid lines. A locking device 77 prevents the pinion 8 from being moved unintentionally in the direction of the toothed rim 10 of the internal combustion engine since this could result in damage to the parts. This unintentional axial movement can occur in that braking moments, e.g. due to the bearings and shaft sealing rings, move the output drive shaft 6 into the meshing position, i.e. the return spring forces are smaller than the axial force components occurring at the steep thread. The construction of the locking device 77 will now be discussed in particular.

Figure 2:
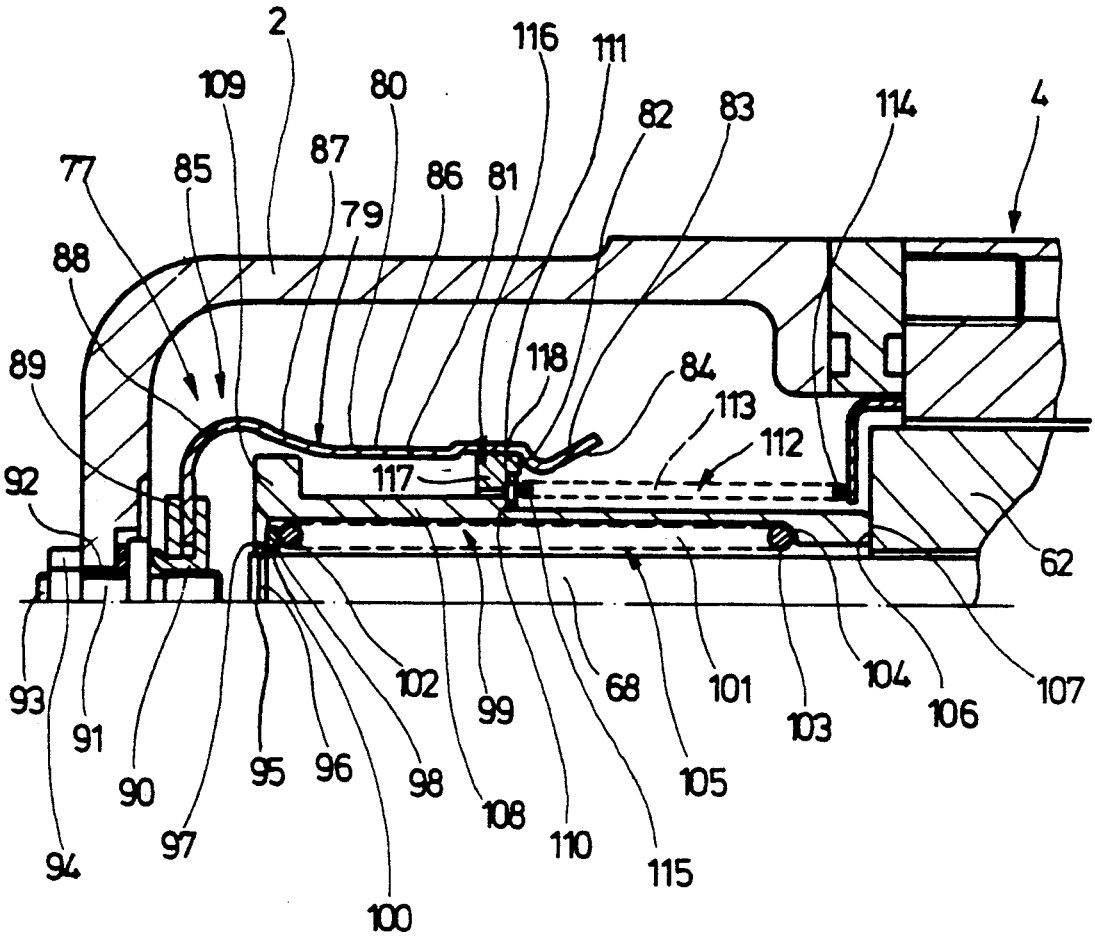
FIG. 2 shows a detailed view of the tappet of an armature of an engaging relay of the device in FIG. 1.

The locking device 77 fixes the position of the engaging lever 70 shown in FIG. 1 in the unexcited state of the engaging relay 4 so that the output drive shaft 6 occupies a fixed axial position. According to the invention, the locking device 77 acts at the armature 62 as already indicated, particularly at the tappet 68 of the engaging relay 4 to secure the rest position of the pinion 8. The locking device 77 has a locking element 78 which is constructed as a first spring 79. The first spring 79 is a stirrup spring 80 (compare also FIG. 2 in particular). The stirrup spring 80 has two legs 81 which are shaped in such a way that each is provided with an undercut step 82. The ends 83 of the two legs 81 are bent out in different directions so that stop slopes 84 are formed. The regions 85 of the legs 81 located opposite the stop slopes 84 are constructed in such a way that—proceeding from the undercut step 82—a portion 86 first extends approximately parallel to the tappet 68 and is adjoined by a control portion 87 which extends out in a different direction and passes into a bent portion 88 which curves relative to the control portion 87. The bend has an angle greater than 90°. The adjoining end 89 of every leg 81 is fastened in a holder 90.

The holder 90 is connected with a threaded screw 91 which extends coaxially relative to the tappet 68 and is supported in a bore hole 92 of the housing 2. The end 93 of the threaded screw 91 projecting out of the housing 2 is secured by a counternut 94.

The tappet 68 connected with the armature 62 of the engaging relay 4 has an annular groove 96 at its free end 95 in which a snap ring 97 is inserted. A disk 98 which is supported on the tappet 68 and is acted upon by a second spring 99 is supported at the snap ring 97. The disk 98 thus forms a tappet stop 100.

The second spring 99 is constructed as a helical pressure spring 101 which spirals around the tappet 68 and is supported with one end 102 at the tappet stop 100 and by the other end 103 at a control sleeve step 104 of a control sleeve 108. The latter is supported on the tappet 68. The control sleeve step 104 is formed in that the control sleeve 108 is penetrated axially by a stepped bore hole 105. The end side 106 facing the armature 62 is pressed against an armature stop 107 by the force of the helical pressure spring 101. The helical pressure spring 101 is supported in the portion of the stepped bore hole 105 having the greater diameter.

The control sleeve 108 has an axially projecting control collar 109 at its end remote of the armature 62, which control collar 109 cooperates with the control portions 87 of the stirrup spring 80 as will be explained in more detail in the following.

The control sleeve 108 varies with respect to its outer diameters so that a control sleeve stop 110 is formed. The control sleeve stop 110 faces the armature 62. A disk 111 is pressed against the control sleeve stop 110 by a third spring 112 constructed as a spiral pressure spring 113 One end 114 of the spiral pressure spring 113 is supported at the housing 2 and the other end 115 is supported at the disk 111. A stop 116 which is constructed as a ring 117 and is located on the portion of the control sleeve 108 having the greater diameter contacts the disk 111. The stirrup spring 80 is supported on the outer surface area 118 of the ring 117 in the positions shown in FIGS. 1 and 2.

It can be seen from FIG. 1 that the driving head 76 does not completely fill the distance between one side 119 of the ring 117 and an end face 120 of the control collar 108; rather an idling path b remains between the latter.

The steep thread 43 allows an axial displacement of the output drive shaft 6 by distance a.

Figure 3:
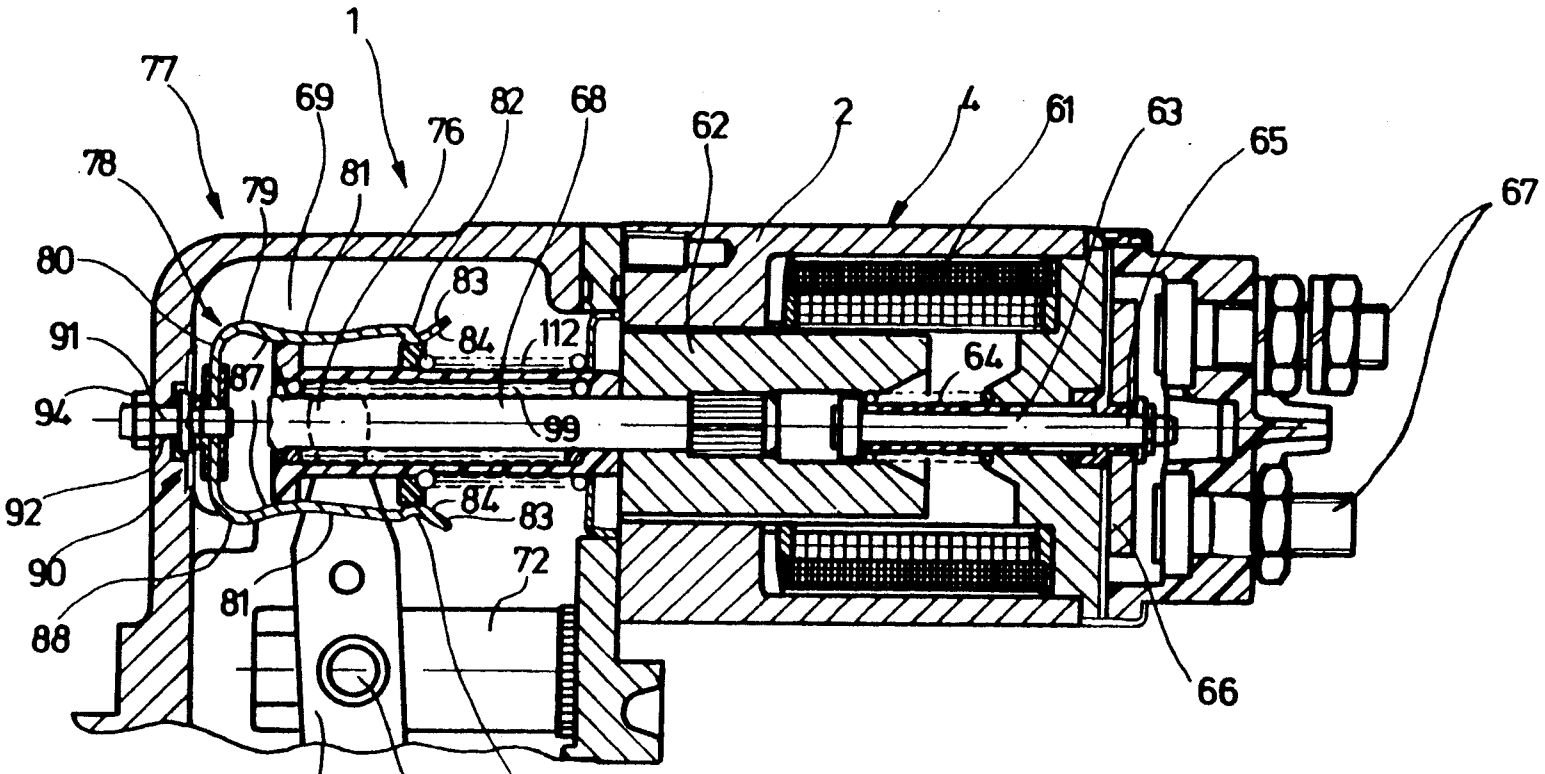
FIG. 3 shows a section of the view of FIG. 1, but in the release position of a locking device cooperating with the armature of the engaging relay.

The starting device 1 according to the invention works in the following manner: The engaging relay 4 is excited via a start switch for a starting process of the internal combustion engine (not shown). As a result of this, the armature 62 is moved to the right (FIG. 1) so that the control collar 109 runs up against the control portions 87 of the stirrup spring 80 in such a way that the latter is spread apart radially. The undercut steps 82 of the legs 81 accordingly release the ring 117. The possibility of a relative movement between the control sleeve 108 and the ring 117, taking up the idling path b, exists as long as the undercut steps 82 engage behind the ring 117 because the ring 117 is supported on the greater diameter of the control sleeve 108 so as to be axially displaceable. The driving of the control sleeve 108 is caused by the axial dislocation of the tappet 68 via the helical pressure spring 101. If the stirrup spring 80 assumes its spread apart position (FIG. 3) the idling path b is used up, i.e. the left side of the driving head 76 is carried along by the end face 120. The engaging lever 70 executes a swiveling movement around the cross-pin 71 in the clockwise direction. In so doing, the projection 74 displaces the output drive shaft 6 in the direction of the toothed rim 10 so that the pinion 8 meshes in the teeth of the toothed rim 10. The occurring meshing forces ensure that the pinion 8 now moves into the toothed rim 10 completely and the output drive shaft 8 moves out axially due to the steep thread 43 so that—as a result—the pinion 8 occupies the position 9 shown in FIG. 1 in dashed lines. If a tooth-on-tooth position of the pinion 8 and toothed rim 10 is effected at first in the meshing process just described, the attraction movement of the engaging relay 4 is not interrupted since the tappet 68 can move relative to the control sleeve 108 due to the second spring 99. Further, an axial relative movement between the pinion 8 and the output drive shaft 6 is also possible because of the helical pressure spring 54. Since the contact element 66 enters into a connection with the electrical connections 67 because of the attracting movement of the engaging relay 4 the D.C. motor 3 is excited, i.e. the starter rotor 5 begins to rotate and the pinion 8 is carried along via the step-down gear unit formed by the sun wheel 26, planet gears 27 and internal geared wheel 30. The tooth-on-tooth position between the pinion 8 and the toothed rim 10 is accordingly canceled so that a meshing can be effected.

When the starting process is terminated the engaging relay 4 drops out. The drop-out movement is reinforced by the return springs 64 and 112. In so doing, the ring 117 strikes against the driving head 76 of the engaging lever 70 with its side 119 so that the engaging lever 70 swivels opposite the clockwise direction and the pinion 8 is brought back into the position shown in solid lines in FIG. 1. Since the internal combustion engine which is now in operation "overruns" the rotation of the pinion 8 in the end stage of the starting process, the disengaging process is reinforced by the steep thread 43.

When the rest position is occupied again (FIG. 1) the stirrup spring 80 is again located in the starting position, i.e. its undercut steps 82 engage behind the ring 117 so that the engaging lever 70 is secured in the position shown in FIG. 1. This prevents an unintentional axial displacement of the output drive shaft 6.

It will be understood that each of the elements described above, or two or more together, may also find a useful application in other types of constructions differing from the types described above.

While the invention has been illustrated and described as embodied in a starting device with drive shaft lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A starting device, comprising a pinion for a drive of a toothed rim of an internal combustion engine; an engaging relay having an armature which axially displaces said pinion; a free wheel device and a stator rotor in which said pinion cooperates; a locking device which prevents a preengagement of said pinion in an unexcited state of said engaging relay, said locking device having a stationary locking element which engages behind a part actuated by said armature for securing a rest position of said pinion, said armature having a tappet on which a control sleeve is arranged, said locking element being formed as a first spring provided with at least one undercut step and deflectable in a release position by said control sleeve arranged on said tappet of said armature.

2. A starting device as defined in claim 1; and further comprising an engaging lever via which said armature axially displaces said piston, said armature with said tappet and said control sleeve traverses an idling path to bring about said release position before said engaging lever is carried along.

3. A starting device as defined in claim 1; and further comprising a second spring, said control sleeve contacting said stop of said armature and being axially displaceable relative to said armature in its drop-out position by a force of said second spring.

4. A starting device as defined in claim 1, wherein said armature has a stop, said locking element being formed as a U-shaped stirrup spring which has portions engaging with said stop of said armature in a drop-out position of said engaging relay.

5. A starting device as defined in claim 4, wherein said stirrup spring is provided with said undercut on each of said portions.

6. A starting device as defined in claim 4, wherein said control sleeve has a core, said stirrup spring being spreadable apart for achieving said release position by said collar of said control sleeve due to displacement of said control sleeve.

7. A starting device as defined in claim 4; and further comprising a housing, said stirrup spring being fastened at said housing so as to be adjustable in direction of the longitudinal extension of said tappet.

8. A starting device as defined in claim 4, wherein said stop is formed by a ring which is supported on said control sleeve.

9. A starting device as defined in claim 8; and further comprising a housing; an engaging lever via which said armature displaces said pinion; and a third spring, said ring having one end side which cooperates with said engaging lever and another end side which cooperates with said third spring so that one end of said third spring is supported at said housing and another end of said third spring is supported at said ring.

10. A starting device as defined in claim 9, wherein said third spring has a force which provides a displacement movement of said ring; and further comprising a control sleeve stop which limits said displacement movement in a drop-out displacement movement of said ring in a drop-out direction.

* * * * *